US006398620B1

(12) United States Patent
Huang

(10) Patent No.: US 6,398,620 B1
(45) Date of Patent: Jun. 4, 2002

(54) LINING PAD FOR A BRASSIERE

(75) Inventor: Hui Lung Huang, Taipei Hsien (TW)

(73) Assignee: Strong Castle Ind. Co., Ltd. (TW)

( * ) Notice: Subject to any disclaimer, the term of this patent is extended or adjusted under 35 U.S.C. 154(b) by 0 days.

(21) Appl. No.: 09/810,455

(22) Filed: Mar. 19, 2001

(30) Foreign Application Priority Data

Feb. 26, 2001 (TW) ..... 90202824

(51) Int. Cl.[7] ..... A41C 3/00
(52) U.S. Cl. ..... 450/57; 450/54
(58) Field of Search ..... 450/38, 54–57; 2/267, 268

(56) References Cited

U.S. PATENT DOCUMENTS 2,891,544 A * 6/1959 London ..... 2/267
3,399,678 A * 9/1968 Faron ..... 2/267 X
4,019,209 A * 4/1977 Spence ..... 2/267 X
4,674,131 A * 6/1987 Broel ..... 2/105
6,213,841 B1 * 4/2001 Kuo ..... 450/55
6,283,820 B1 * 9/2001 Huang ..... 450/57
6,299,505 B1 * 10/2001 Huang ..... 450/57

* cited by examiner

*Primary Examiner*—Gloria M. Hale
(74) *Attorney, Agent, or Firm*—Troxell Law Office PLLC

(57) ABSTRACT

A lining pad for a brassiere provides an external layer and an internal layer, which are made of elastic foamed material and have a shape corresponding to a bra cup of the brassiere respectively. An intermediate layer is sandwiched between the external and the internal layers and not corresponding to a breast so as to constitute a support part with relatively less elasticity.

6 Claims, 3 Drawing Sheets

LINING PAD FOR A BRASSIERE

BACKGROUND OF THE INVENTION

1. Field of the Invention:

The present invention relates to a lining pad for a brassiere, and particularly to an improvement of lining pad, which is arranged in a brassiere to perform a better function for the wearer.

2. Description of Related Art:

The breasts of a female basically are responsible for feeding a little baby so that usually they are bigger than those of a male. Due to bigger size, the breasts of a female become one of important sex characters for women. In the meantime, the outline of breasts is an important part to affect the figure of a woman so that it is the reason why the bust is one of woman's three bodylines.

In fact, women usually care about their breasts very much. But, due to race, constitution, or inborn heredity and acquired nutrition, the growth of breasts for each woman is different from each other. Hence, there are still a lot of women dissatisfying the breasts their own. In order to enhance the beauty of breasts, some women mind to decorate their breasts by way of foreign fillings attractively so as to keep their figure in shape.

On the other hand, it is necessary for a woman to wear her underwear or so called "brassiere" because the breasts of a woman are more conspicuous than a man. The brassiere can prevent the breasts from droop and expanding laterally or from taking exercise. Therefore, a female keeps a much close relation with the brassiere all her life since she was grown up.

Regardless of being with shoulder belt or without shoulder belt, the underwear for a woman basically requires two bra cups with woven cloth attached to the inner and the outer layers thereof. In addition, a steel wire is added to the underwear at the lower edge thereof to provide a support for enhancing beautification. Taking advantage of the development of material science, the bra cups are popularly made of foam material and formed as a shape of cup respectively so as to receive the breasts at the time of being worn. Meanwhile, the bra cups can be thickened to provide lining pad respectively in order to perform the preceding function of decoration or to make up less full and round breasts.

There are a variety of lining pads having been developed and available in the market. For instance, the lining pad is formed by way of foaming directly to thicken the bra cups. Some of lining pads are made to contain water bag or oil bag and other lining pads are made to add magnets or scent stuffs. Nevertheless, a general shortcoming residing in the prior art is that there is no distinction between the part receiving the breasts and the part surrounding the breasts, especially the part surrounding the lower edge of breasts.

In reality, a lining pad should be divided into a swelled breast part and a lower edge part such that the former has to be thickened with soft foam material and the later has a primary function of breast supporting and snugly locating. But, the prior art having the entire lining pad being provided with identical material and softness does not offer the function of snug locating and is not possible to support the breast and to limit an expanded breast. Accordingly, how to meet the requirement of wearing a,brassiere is a subject worth us to concern about.

SUMMARY OF THE INVENTION

An object of the present invention is to provide a lining pad for a brassiere, which offers a lower support part with less elasticity to be located at the lower edge of breasts snugly.

BRIEF DESCRIPTION OF THE DRAWINGS

The present invention can be more fully understood by referring to the following description and accompanying drawings, in which.

DETAILED DESCRIPTION OF THE PREFERRED EMBODIMENTS

Figure 1:
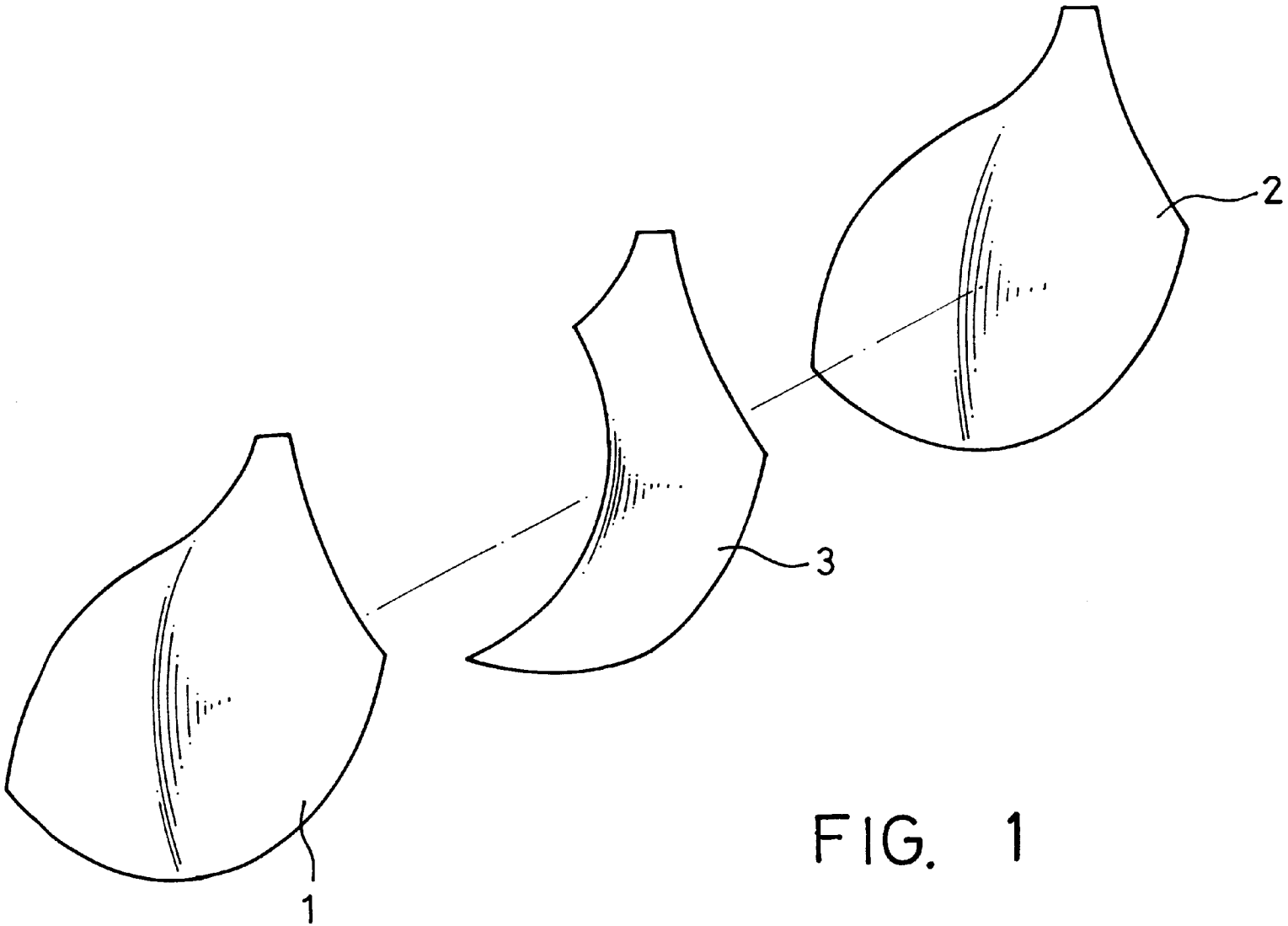
FIG. 1 is an exploded perspective view of a brassiere pad according to the present invention.

Referring to FIG. 1, a lining pad for a brassiere according to the present invention basically comprises an external layer 1, an internal layer 2, and an intermediate layer 3.

Wherein, the external layer 1 and the internal layer 2 are made of elastic foam material and are formed to have about the same shape as a cup. A flat material can be prepared to make the external layer 1 and the internal layer 2 by way of a molding tool.

The intermediate layer 3 can be made of the same material as the external layer 1 or the internal layer 2, woven cloth or non-woven cloth possible for being bonded. Furthermore, the intermediate layer 3 can be cut from a slice of material so as to form a shape corresponding to the part other than the breast, that is, the intermediate layer 3 provides a shape not corresponding to the part of the breast.

While the lining pad for a brassiere according to the present invention is made, the intermediate layer 3 at both facial sides thereof or the respective inner facial side of external and internal layer 1, 2 is coated with adhesive such that the intermediate layer 3, the internal layer 2, and the external layer 3 can be bonded together as a work piece. Then, the bonded work piece is pressed and heated up in a molding tool so that the intermediate layer 3 can be integrated with the internal layer 3 and the external layer 1 to form a tight support part 4 with less elasticity. The support part 4 keeps contact with the area surrounding the breast, especially the lower edge of breast, as soon as the brassiere is worn to perform the function of support. Due to less elasticity, the support part 4 is not extended easily so that it is possible for the brassiere being located well.

Figure 2:
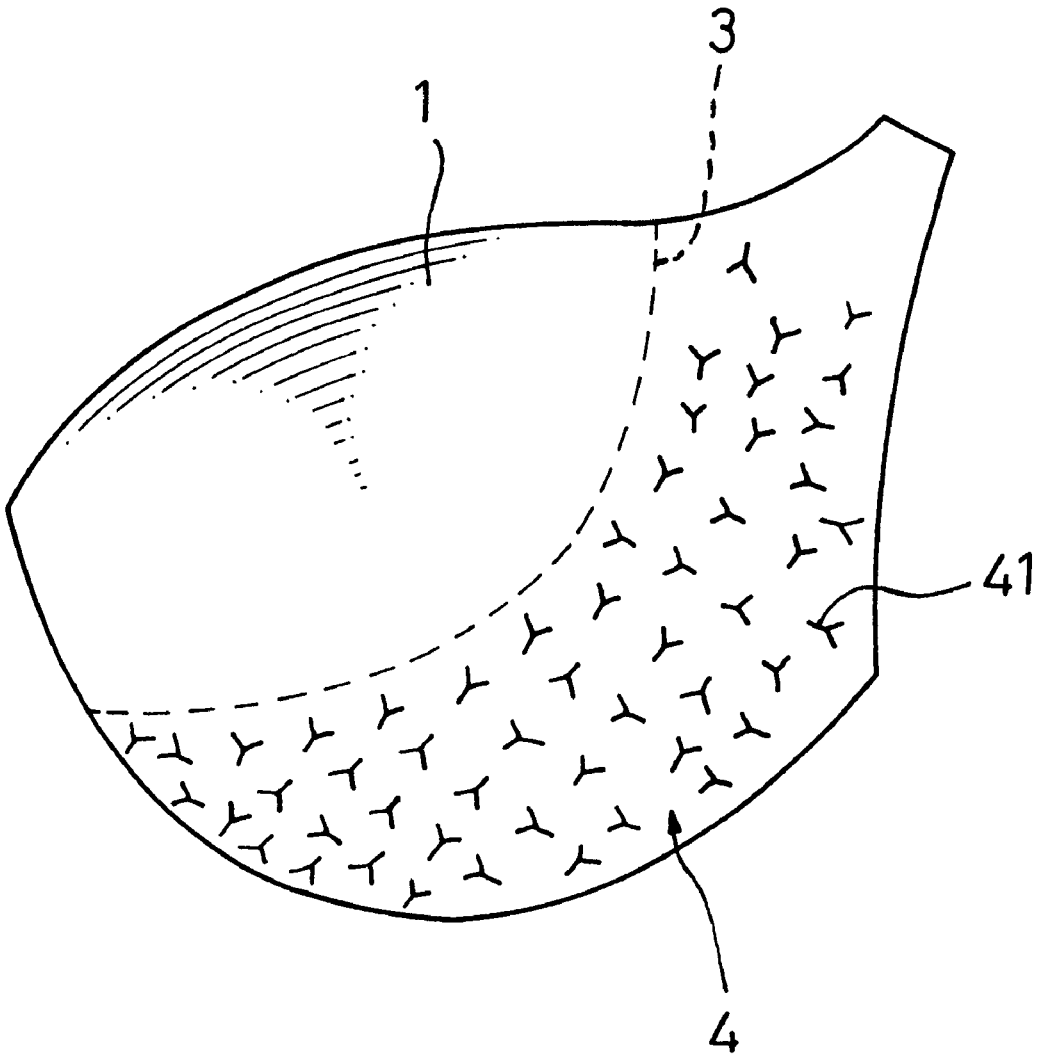
FIG. 2 is a perspective view of a finished brassiere pad according to the present invention.

In order to enhance the ventilation at the time of contacting the skin, the support part 4 may be provided with a plurality of air openings 41 and said air openings 41 can be circular or other shapes, or cut clearances as shown in FIG. 2.

Figure 3:
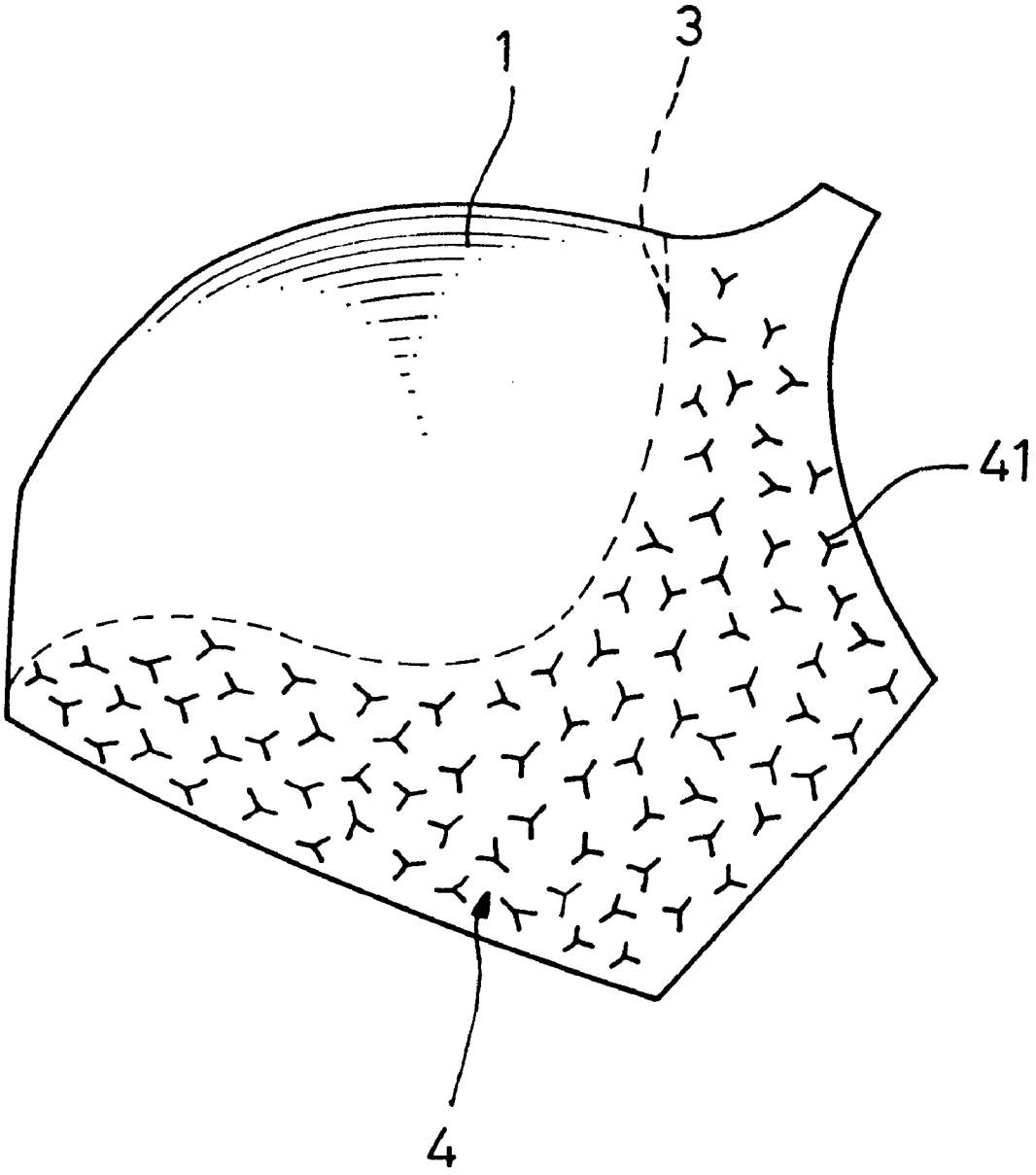
FIG. 3 is a perspective view of brassiere pad according to the present invention in another embodiment thereof.

Referring to FIG. 3, the support part 4 can be hardened by way of the thickness of intermediate layer 3, that is, the support part 4 may become harder with less flexibility of extension as soon as the intermediate layer 3 is provided with a larger thickness. In this way, it is not necessary to use the steel wire as the conventional brassiere does.

It is appreciated that the lining pad of present invention is able to locate the breast in the bra cup effectively and the support part 4 can keep contact with the chest muscle at the lower edge of or surrounding the breast firmly without any displacement resulting from extension. Hence, a brassiere made with the lining pad of present invention can be worn snugly in addition to holding the breast properly and can prevent the breast from droop and lateral expansion. Furthermore, a stiffer support part 4 makes the brassiere not necessary to provide a steel wire such that it is not only save a production cost but also avoid the trouble caused by cleaning the brassiere afterward.

While the invention has been described with reference to a preferred embodiment thereof, it is to be understood that modifications or variations may be easily made without departing from the spirit of this invention, which is defined by the appended claims.

What is claimed is:

1. A lining pad for a brassiere, comprising:

an external layer, of elastic foamed material, and having a shape corresponding to a bra cup of the brassiere;

an internal layer, of elastic foamed material, and having a shape corresponding to the bra cup; and an intermediate layer mounted between the external and the internal layers, and having a shape smaller than that of the external and internal layers and corresponding to only a portion of the bra cup whereby a portion of the lining pad having the intermediate layer forms a breast support portion with less elasticity than the external layer and the internal layer.

2. The lining pad for a brassiere according to claim 1, wherein the external layer, the internal layer, and the intermediate layer are same material.

3. The lining pad for a brassiere according to claim 1, wherein the intermediate layer is woven cloth.

4. The lining pad for a brassiere according to claim 1, wherein the external layer, the internal layer, and the intermediate layer are made of polyester.

5.The lining pad for a brassiere according to claim 1, wherein the support portion is provided with air openings for ventilation.

6.The lining pad for a brassiere according to claim 1, wherein the intermediate layer is a non-woven cloth.

* * * * *